US007074050B1

(12) United States Patent
Bartley et al.

(10) Patent No.: US 7,074,050 B1
(45) Date of Patent: Jul. 11, 2006

(54) SOCKET ASSEMBLY WITH INCORPORATED MEMORY STRUCTURE

(75) Inventors: Gerald Keith Bartley, Rochester, MN (US); Darryl John Becker, Rochester, MN (US); Paul Eric Dahlen, Rochester, MN (US); Philip Raymond Germann, Oronoco, MN (US); Andrew Benson Maki, Rochester, MN (US); Mark Owen Maxson, Mantorville, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/282,083

(22) Filed: Nov. 17, 2005

(51) Int. Cl.
*H01R 12/00* (2006.01)

(52) U.S. Cl. ..... 439/73

(58) Field of Classification Search ..... 439/73, 439/331

See application file for complete search history.

(56) References Cited

U.S. PATENT DOCUMENTS

| | | | | |
|---|---|---|---|---|
| 5,109,317 | A * | 4/1992 | Miyamoto et al. | 361/715 |
| 5,267,867 | A * | 12/1993 | Agahdel et al. | 439/73 |
| 6,181,567 | B1 * | 1/2001 | Roemer et al. | 361/760 |
| 2005/0174744 | A1 * | 8/2005 | Zheng | 361/760 |
| 2005/0276029 | A1 * | 12/2005 | Lober | 361/769 |

* cited by examiner

*Primary Examiner*—Tho D. Ta
(74) *Attorney, Agent, or Firm*—Joan Pennington

(57) ABSTRACT

A socket assembly with incorporated memory structure is provided. A chip carrier socket assembly includes dual stage clamping actuation. A first clamping actuation stage provides clamping force for ball grid array (BGA) contact pads and a second clamping actuation stage provides clamping force for a thermal interface. The first clamping actuation stage provides clamping force proximate to a perimeter of a carrier where a plurality of BGA contact pads are located. The second clamping actuation stage provides clamping force generally centrally of the chip carrier socket assembly for thermal interface actuation.

14 Claims, 2 Drawing Sheets

SOCKET ASSEMBLY WITH INCORPORATED MEMORY STRUCTURE

FIELD OF THE INVENTION

The present invention relates generally to the electronic packaging field, and more particularly, relates to a socket assembly with incorporated memory structure.

RELATED APPLICATION

A related application entitled STACKING METHOD AND STRUCTURE FOR ATTACHING MEMORY OR SIMILAR COMPONENTS TO A BGA TYPE DEVICE by Gerald K. Bartley, Darryl J. Becker, Paul E. Dahlen, Philip R Germann, Andrew B. Maki, Mark O. Maxson, Ser. No. 11/282,082, is being filed on the same date herewith.

DESCRIPTION OF THE RELATED ART

Modern computer architectures require low latency paths to memory to optimize performance. The challenge to the electrical package design is to define short wiring paths to the memory devices.

Also providing a removable connection scheme to the memory would allow for scalability of the memory, which is beneficial for field upgradability, to facilitate flexible system customization and reduced cost of assembly or rework operations.

Moreover, removable memory integrated into a chip carrier test/debug socket would enhance processor module performance screening, functionality testing, and/or built-in self-test (BIST) enablement.

As used in the following description and claims the terms ball grid array (BGA) device and BGA connections are not limited to BGA solder connections and should be understood to include multiple various other chip carrier technologies including, for example, Land Grid Array (LGA), pin grid array, and copper—copper thermal compression connections and devices.

A need exists for an improved mechanism to define short wiring paths to the memory devices electrical package design. It is desirable to provide such mechanism enabling a removable connection of the memory.

SUMMARY OF THE INVENTION

A principal aspect of the present invention is to provide a socket assembly with incorporated memory structure. Other important aspects of the present invention are to provide such socket assembly with incorporated memory structure substantially without negative effect and that overcome many of the disadvantages of prior art arrangements.

In brief, a socket assembly with incorporated memory structure is provided. The chip carrier socket assembly includes dual stage clamping actuation. A specialized carrier includes multiple memory devices. A mating supporting carrier includes a plurality of ball grid array (BGA) contact pads for connection with said specialized carrier. A first clamping actuation stage provides clamping force for ball grid array (BGA) contact pads and a second clamping actuation stage provides clamping force for a thermal interface.

In accordance with features of the invention, the first clamping actuation stage provides clamping force proximate to an enlarged opening of the specialized carrier where a plurality of BGA contact pads are located. The second clamping actuation stage provides clamping force generally centrally of the chip carrier socket assembly for thermal interface actuation.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the preferred embodiments, a chip carrier socket design with dual actuation provides separate clamping force for BGA contact pads and a thermal interface. The chip carrier socket design defines short wiring paths to the memory devices. A removable connection feature for the memory of the chip carrier socket allows for scalability of the memory, which is beneficial for field upgradability. Also removable memory integrated into the chip carrier socket advantageously includes test or debug capability to enhance processor module performance screening, functionality testing, and built-in self-test (BIST) enablement.

Figure 1:
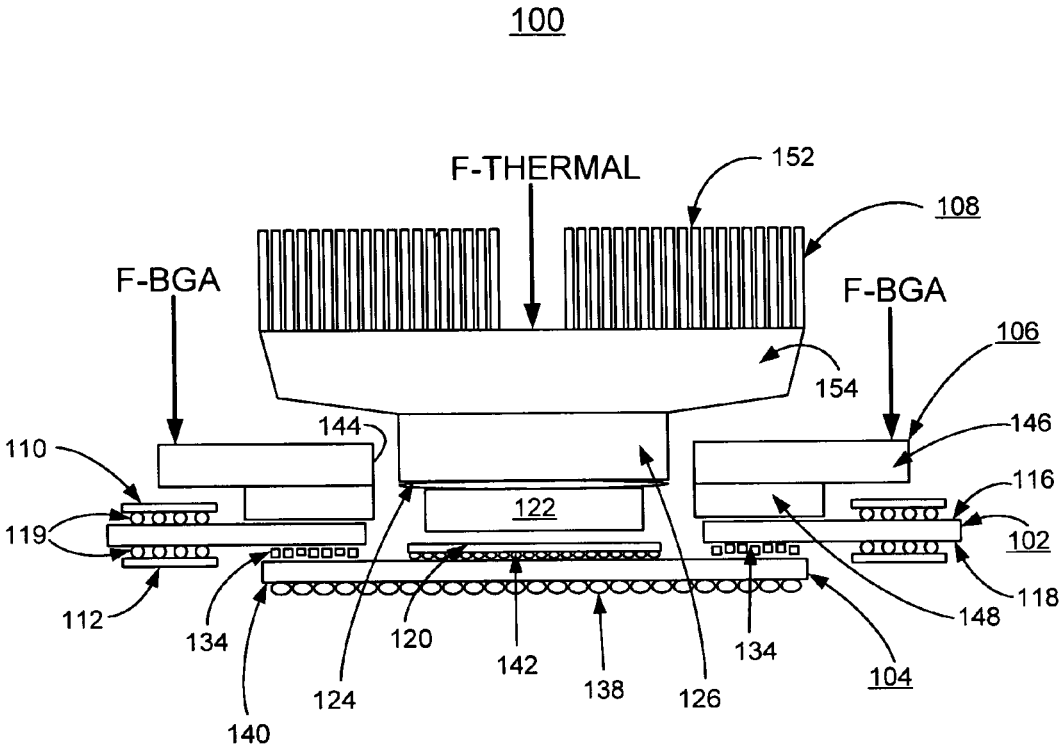
FIG. 1 is a partly schematic and cross-sectional side view not to scale of a socket assembly with incorporated memory structure in accordance with the preferred embodiment.
Figure 2:
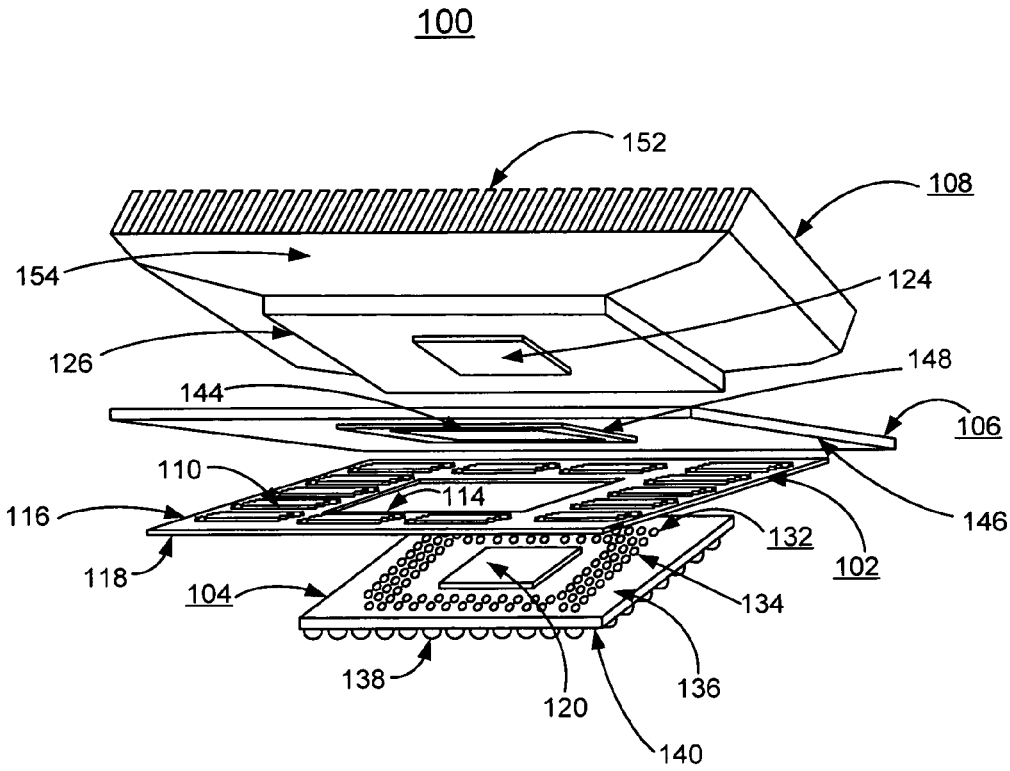
FIG. 2 is an exploded perspective view not to scale illustrating the socket assembly with incorporated memory structure of FIG. 1 in accordance with the preferred embodiment.

Having reference now to the drawings, in FIGS. 1 and 2, there is shown a socket assembly generally designated by the reference character 100 in accordance with the preferred embodiment. Socket assembly 100 includes a specialized carrier generally designated by the reference character 102 for stacked engagement with a mating chip carrier generally designated by the reference character 104. Socket assembly 100 includes a first actuation stage 106 providing clamping force for ball grid array (BGA) contact pads and a second stage 108 provides clamping force for a thermal interface.

The first clamping actuation stage 106 provides clamping force schematically indicated by a pair of arrows labeled F-BGA. The clamping force is applied proximate to a carrier surface at the location where the carrier surface is aligned with a plurality of BGA contact pads. The second clamping actuation stage 108 provides clamping force schematically indicated by a pair of arrows labeled F-THERMAL generally centrally of the chip carrier socket assembly 100 for thermal interface actuation.

Various conventional clamping arrangements can be used, for example, multiple C-clamps placed around the edges of the mating surfaces sandwiched between backing plates (not shown). Also a plurality of bolts can extend through holes in the various layers of the structure 100 and through backing plates, and can be secured by nuts to provide the clamping pressure.

In accordance with features of the preferred embodiments, the specialized carrier 102 is electrically connected via the first actuation stage 106 whereby an interconnect path is provided through a topside of the mating chip carrier 104. This actuation could be via LGA like pads, Gold on Gold pads, compliant members such as what is used in LGA, and the like. This interconnect allows for memory, flash, or gate-array memory close to an associated chip on the base carrier.

As shown in FIG. 1, specialized carrier 102 includes a plurality of devices 110 and 112, such as memory die, or chip scale packaging (CSP) memory, respectively supported on opposite surfaces of the carrier. Devices 110 and 112 on the specialized carrier 102 could encompass logic to enable test, patterns, control, and the like, to enable a very inexpensive tester utilizing on chip BIST like approaches. Specialized carrier 102 includes a generally centrally located opening or cut out 114. Multiple devices 110, 112 respectively are mounted proximate to the cut out 114 on a top surface 116 and a bottom surface 118 of the specialized carrier 102 by a plurality of electrical connections 119 each arranged as, for example, a ball grid array (BGA) for electrically connecting to the specialized carrier 102.

Mating chip carrier 104 includes a generally centrally located chip die 120, such as a processor die. The cut out 114 in the specialized carrier 102 is provided to accommodate the centrally located die 120 of the mating chip carrier 104, an optional spreader 122 coupled between the chip die 120, a thermal interface 124, and a heatsink member mating portion 126.

Mating chip carrier 104 includes a predefined pattern generally designated by the reference character 132 of electrical connections 134 on an upper surface 136 arranged as, for example, a ball grid array (BGA) for electrically connecting to the specialized carrier 102. Mating chip carrier 104 includes a plurality of electrical connections 138 on a lower surface 140 arranged, for example, for removable connection using standard socketting techniques to a printed circuit board (PCB), not shown. Mating chip carrier 104 includes a plurality of electrical connections 142 on the upper surface 136 arranged as, for example, a ball grid array (BGA) for electrically connecting to the chip die 120.

First actuation stage 106 providing clamping force for ball grid array (BGA) contact pads 134 includes a generally centrally located opening or cut out 144. First actuation stage 106 includes an enlarged upper portion 146 and a lower portion 148 in clamping-force-transfer engagement with the upper surface 116 of the specialized carrier 102 above the BGA electrical connections 134.

Second stage 108 providing clamping force to the thermal interface 124 includes a plurality of upper heat sink fins 152 carried by an outwardly extending portion 154 located above the mating heatsink member 126 and thermal interface 124.

While the present invention has been described with reference to the details of the embodiments of the invention shown in the drawing, these details are not intended to limit the scope of the invention as claimed in the appended claims.

What is claimed is:

1. A chip carrier socket assembly with incorporated memory structure comprising:

a specialized carrier including multiple memory devices;

a mating supporting carrier including a plurality of ball grid array (BGA) contact pads for connection with said specialized carrier; and an associated ball grid array (BGA) device for the multiple memory devices;

a first clamping actuation stage providing clamping force for said ball grid array (BGA) contact pads; and a second clamping actuation stage providing clamping force for a thermal interface to the associated ball grid array (BGA) device.

2. A chip carrier socket assembly as recited in claim 1 wherein said multiple memory devices are disposed proximate to a generally centrally disposed opening in said specialized carrier.

3. A chip carrier socket assembly as recited in claim 1 wherein said first clamping actuation stage provides clamping force proximate to a perimeter of a mating supporting carrier where a plurality of BGA contact pads are located.

4. A chip carrier socket assembly as recited in claim 1 wherein said second clamping actuation stage provides clamping force generally centrally of the chip carrier socket assembly for thermal interface actuation.

5. A chip carrier socket assembly as recited in claim 1 wherein said multiple memory devices include memory die.

6. A chip carrier socket assembly as recited in claim 1 wherein said multiple memory devices include chip scale packaging (CSP) memory.

7. A chip carrier socket assembly as recited in claim 1 wherein said specialized carrier includes a generally centrally disposed opening generally aligned with and surrounding said associated ball grid array (BGA) device of the mating supporting carrier in the chip carrier socket assembly.

8. A chip carrier socket assembly as recited in claim 1 wherein said first clamping actuation stage includes a generally centrally disposed opening generally aligned with and surrounding said associated ball grid array (BGA) device of the mating supporting carrier in the chip carrier socket assembly.

9. A chip carrier socket assembly as recited in claim 1 wherein said first clamping actuation stage provides said clamping force for said ball grid array (BGA) contact pads without applying clamping force to associated ball grid array (BGA) device.

10. A chip carrier socket assembly as recited in claim 1 wherein said second clamping actuation stage provides said clamping force for said thermal interface without applying clamping force to said ball grid array (BGA) contact pads.

11. A chip carrier socket assembly as recited in claim 1 wherein said first clamping actuation stage and said second clamping actuation stage are separate stages providing independent clamping force.

12. A chip carrier socket assembly as recited in claim 1 wherein said thermal interface includes an associated ball grid array (BGA) device for the multiple devices.

13. A chip carrier socket assembly as recited in claim 1 wherein said thermal interface includes a spreader carried by the associated ball grid array (BGA) device for the multiple devices.

14. A method for fabricating a chip carrier socket assembly comprising:

providing a specialized carrier including multiple memory devices', providing a mating supporting carrier including a plurality of ball grid array (BGA) contact pads for electrical connection with said specialized carrier; and the mating supporting carrier including an associated ball grid array (BGA) device for the multiple devices;

providing clamping force for said ball grid array (BGA) contact pads with a first clamping actuation stage for electrically connecting said specialized carrier to said mating supporting carrier; and providing clamping force for a thermal interface to said associated ball grid array (BGA) device with a second clamping actuation stage.

* * * * *